US009511302B2

(12) United States Patent
Hoé

(10) Patent No.: US 9,511,302 B2
(45) Date of Patent: Dec. 6, 2016

(54) TOY WHEEL ASSEMBLY AND A METHOD FOR MANUFACTURING THE SAME

(71) Applicant: LEGO A/S, Billund (DK)

(72) Inventor: Mikkel Schildknecht Hoé, Juelsminde (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 14/430,562

(22) PCT Filed: Sep. 27, 2013

(86) PCT No.: PCT/EP2013/070205
§ 371 (c)(1),
(2) Date: Mar. 24, 2015

(87) PCT Pub. No.: WO2014/049126
PCT Pub. Date: Apr. 3, 2014

(65) Prior Publication Data

US 2015/0265935 A1 Sep. 24, 2015

(30) Foreign Application Priority Data

Sep. 28, 2012 (DK) ..... 2012 70592

(51) Int. Cl.
*A63H 17/00* (2006.01)
*A63H 17/26* (2006.01)

(52) U.S. Cl.
CPC ..... *A63H 17/262* (2013.01)

(58) Field of Classification Search
USPC ... 446/431, 434, 465, 469, 470; 301/111.01, 301/111.03, 111.04
See application file for complete search history.

(56) References Cited

U.S. PATENT DOCUMENTS 2,615,759 A 10/1952 Becker
2,778,159 A * 1/1957 Irwin ..... A63H 17/262 301/1
4,170,083 A * 10/1979 Freelander ..... A63H 33/108 446/107
4,299,051 A * 11/1981 Pauly ..... A63H 17/262 301/118
4,375,139 A 3/1983 Chatani
4,690,656 A 9/1987 Friedman et al.
4,900,095 A * 2/1990 Brubaker ..... A63H 17/262 152/396

(Continued)

FOREIGN PATENT DOCUMENTS

CN 201111434 Y 9/2008
EP 0128449 A2 12/1984

(Continued)

OTHER PUBLICATIONS

International Search Report issued in co-pending international application No. PCT/EP2013/070205, dated Nov. 14, 2013.

(Continued)

*Primary Examiner* — Kurt Fernstrom
(74) *Attorney, Agent, or Firm* — Day Pitney LLP

(57) ABSTRACT

The present invention relates to a toy wheel assembly (100), a molding tool for the same and a method for manufacturing said toy wheel assembly (100). In particular, the present invention provides a self-locking toy wheel assembly (100) for improved toy safety.

9 Claims, 1 Drawing Sheet

(56) References Cited

U.S. PATENT DOCUMENTS

| | | | | |
|---|---|---|---|---|
| 5,368,371 | A | 11/1994 | Markling | |
| 5,947,795 | A * | 9/1999 | Cohen | B60B 37/10 296/177 |
| 6,561,593 | B2 * | 5/2003 | Godwin | B65F 1/1473 301/111.04 |
| 6,637,835 | B2 * | 10/2003 | Morris | B60B 3/001 301/111.01 |
| 6,886,893 | B1 * | 5/2005 | Fisch | B60B 5/02 301/111.01 |
| 7,614,707 | B2 * | 11/2009 | Jabbour, Jr. | B60B 3/001 301/111.01 |
| D641,805 | S * | 7/2011 | Kichijo | D21/495 |
| D738,439 | S * | 9/2015 | Kanbar | D21/493 |
| 2003/0085611 | A1 | 5/2003 | Markling | |

FOREIGN PATENT DOCUMENTS

| | | | |
|---|---|---|---|
| EP | 1555052 | A1 | 7/2005 |
| GB | 1080302 | A | 8/1967 |
| GB | 1301142 | A | 12/1972 |
| WO | 9308885 | A1 | 5/1993 |

OTHER PUBLICATIONS

Search Report issued in Danish priority application No. PA 2012 70592, dated Mar. 13, 2013.

* cited by examiner

TOY WHEEL ASSEMBLY AND A METHOD FOR MANUFACTURING THE SAME

CROSS-REFERENCE TO RELATED APPLICATIONS

This application is a U.S. National Stage of International Application No. PCT/EP2013/070205, filed on 27 Sep. 2013 and published on 3 Apr. 2014, as WO 2014/049126A1, which claims the benefit of priority to Danish Patent Application No. PA 2012 70592, filed on 28 Sep. 2012.

FIELD OF INVENTION

The present invention is in the field of toys for children. In particular, the present invention relates to a toy wheel assembly, a moulding tool for the same and a method for manufacturing said toy wheel assembly.

BACKGROUND

Toy associated accidents are quite common, with 40,000 accidents happening each year in the United Kingdom, which accounts for less than 1% of annual accidents. In 2005 in the U.S., 20 children under 15 years of age died in incidents associated with toys, and an estimated 202,300 children under 15 were treated in U.S. hospital emergency rooms for injuries associated with toys, according to data from the U.S. Consumer Product Safety Commission's National Electronic Injury Surveillance System.

In the 2010 report from the U.S. Consumer Product Safety Commission, the number of toy related injuries treated in of U.S. hospital emergency hospitals is estimated to be 251,700 for all ages of which the number of injuries of children under 5 years is estimated to be around 89,000. Toys were associated with the death of 17 children under 15 in 2010 of which the majority of the children are 6 years old or younger.

Choking or aspiration of small parts of the toy may cause serious injuries (airway obstruction, asphyxiation) or in worst case it may even lead to a loss of life. According to the U.S. Consumer Product Safety Commission's report, the majority of the toy related deaths in 2010 were associated with airway obstruction or asphyxiation due to choking or aspiration of toys or small parts of the same.

Magnetix was a magnetic construction toy consisting of a combination of plastic building pieces containing embedded neodymium magnets, and steel bearing balls which can be connected together to form various geometric shapes and structures.

In 2006, the Consumer Product Safety Commission (CPSC) ordered a recall of all Magnetix brand magnetic building sets. The official CPSC recall notice was issued after one death of a small child and four serious injuries requiring surgery.

Toy safety is the practice of ensuring that toys, especially those made for children, are safe, usually through the application of set safety standards. In many countries, commercial toys must be able to pass safety tests in order to be sold. In the U.S., some toys must meet national standards, while other toys may not have to meet a defined safety standard. In countries where standards exist, they exist in order to prevent accidents, but there have still been some high-profile product recalls after such problems have occurred. The danger is often not due to faulty design; usage and chance both play a role in injury and death incidents as well.

GB1080302 (Carr Fastener Company Limited) discloses means for attaching an axle to the wheel of a toy. In particular, GB1080302 provides an assembly comprising a wheel and an axle therefore both formed of synthetic plastics, an end of the axle being secured in a recess in the wheel by a metal clip comprising a tubular body encircling the axle and provided with one or more inwardly extending tongues frictionally gripping the axle and one or more outwardly projecting tongues frictionally gripping the wall of the recess.

GB1301142 (INTERLEGO AG) concerns simple, efficient and inexpensive fastening means which enables even quite small children to fix the wheel elements safely and securely on the shaft elements without any requirements of skill and accuracy and without any use of tools or accessories. Accordingly, GB1301142 discloses a wheel and shaft arrangement for a toy building set comprising a shaft element having a portion with a non-circular cross-section, a wheel element adapted to be mounted on said portion of the shaft element for rotation therewith, said wheel element having a central bore, the contour of which conforms with the cross-sectional contour of said portion of the shaft element, a recess in the wheel element surrounding the central bore therein, an annular spring adapted to be inserted in the recess and exert a, radial pressure on said portion of the shaft element when the wheel element is mounted thereon, and a hub element adapted to be attached to the wheel element to close the recess so as to define an enclosed annular cavity enclosing the spring.

It follows from the above, that although much attention is on toy safety, there still is a need for improving the safety of toys to avoid toy associated injuries and deaths. In particular, there is a need for improving the safety of toys for younger children to avoid injuries caused by choking or aspiration of small parts of toys.

BRIEF DESCRIPTION OF THE INVENTION

A first aspect of the present invention relates to a toy wheel assembly. In particular, the aspect concerns a toy wheel assembly preferably for a toy vehicle, said toy wheel assembly includes a rim, a tyre and an axle where said tyre is configured to encircle an outer periphery of said rim when mounted on said rim, and where said axle is configured to be connected to said rim, coaxially with said rim, under a connection allowing said rim to rotate coaxially on said axle, wherein said rim include one or more barbs configured to engage radially with an external encircling groove provided on said axle when said axle is inserted into an axle receiving hole in said rim and in that said one or more barbs are maintained in said encircling groove by an interior face of said tyre when said tyre is mounted on said rim.

The toy wheel assembly of the present invention may form part of a complex toy brick construction and the like. Apart from contributing to the functional property of the toy, the toy wheel assembly may also contribute to structural integrity of the toy of which it forms a part/element.

According to a second aspect, the present invention relates to a chassis for toy vehicle comprising at least one toy wheel assembly of the present invention According to a third aspect, the present invention relates to a toy vehicle comprising at least one toy wheel assembly of the present invention.

According to a fourth aspect, the present invention relates to a kit comprising a toy wheel assembly of the present invention preferably mounted on a toy vehicle or the chassis for a toy vehicle.

According to a further aspect, the present invention relates to a moulding tool for manufacturing the toy wheel assembly of the present invention.

According to yet further aspect, the present invention relates to a method of manufacturing the toy wheel assembly of the present invention.

DETAILED DESCRIPTION WITH REFERENCE TO THE FIGURES

Figure 1:
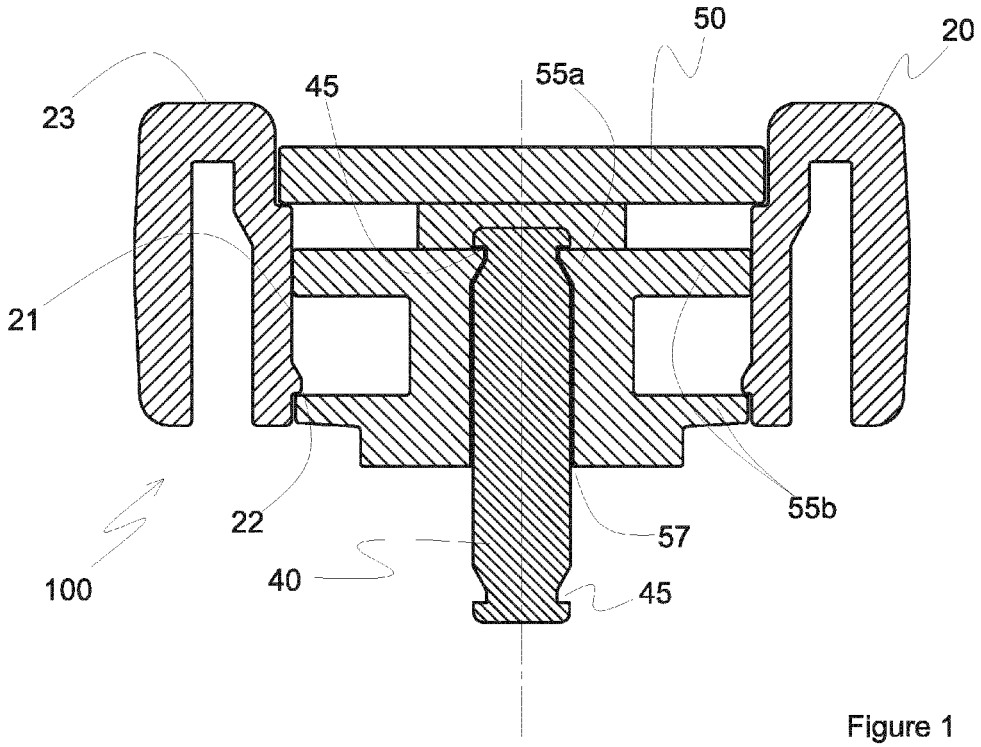
FIG. 1 shows a principal sectional view through an assembled toy wheel assembly according to one aspect of the present invention.
Figure 2:
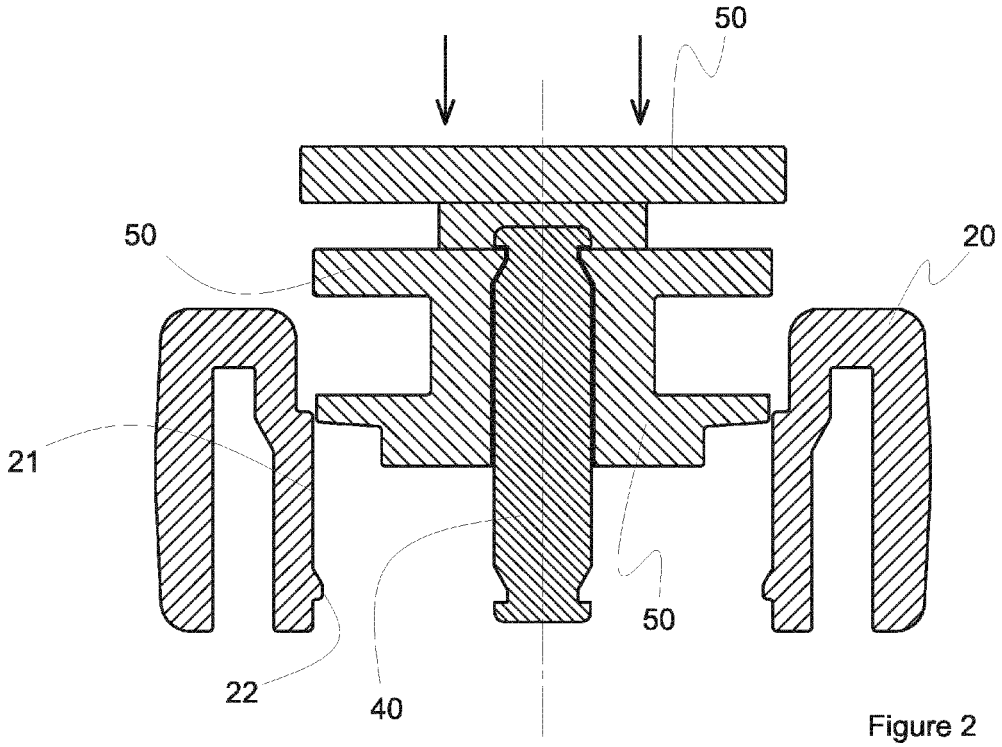
FIG. 2 shows a principal sectional view through a disassembled toy wheel assembly according to one aspect of the present invention.

It is an object of the present invention to set forth a solution to the abovementioned insufficiencies of today's practices. In particular, it is an object of the present invention to provide a toy wheel assembly with improved child safety, i.e. a toy wheel assembly, which cannot easily be pulled apart and accidentally swallowed or aspirated.

The solution to the posed problem is accomplished by providing the self-locking toy wheel assembly 100 of the present invention.

Apart from the self-locking properties of the toy wheel assembly 100 of the present invention, a further advantage is that the locking mechanism may easily be safety tested after mounting the assembly e.g. on the chassis of a toy vehicle, simply by pulling the mounted toy wheel assembly 100 holding the chassis in a fixed position. This simple and fast safety test of the assembly is a particular advantage when the toy wheel assembly 100 is mounted and tested by the manufacturer.

A first aspect of the present invention concerns a toy wheel assembly 100 preferably for a toy vehicle, said toy wheel assembly 100 includes a rim 50, a tyre 20 and an axle 40 where said tyre 20 is configured to encircle an outer periphery of said rim 50 when mounted on said rim 50, and where said axle 40 is configured to be connected to said rim 50, coaxially with said rim 50, under a connection allowing said rim 50 to rotate coaxially on said axle 40 wherein said rim 50 include one or more barbs 55*a* configured to engage radially with an external encircling groove 45 provided on said axle 40 when said axle 40 is inserted into an axle receiving hole 57 in said rim 50 and in that said one or more barbs 55*a* are maintained in said external encircling groove 45 by an interior face 21 of said tyre 20 when said tyre is mounted on said rim 50.

It follows that once the axle 40 is inserted in the receiving hole 57, the one or more barbs 55*a* will interact with the externally encircling groove 45 on said axle 40 and prevent that the axle 40 is removed from the rim 50. The external encircling groove 45 on said axle 40 may be fully encircling or partly encircling and the receiving hole 57 adapted accordingly to accomplish the locking mechanism. With the tyres 20 mounted on the rim 50, the axle 40 will be even more firmly locked and maintained on the rim 50 since any flexibility in the rim and around the receiving hole 57 will be absorbed by the tyres 20 firmly attached and encircling the rim 50.

In one embodiment, said tyre 20 and said rim 50 is configured to be drawn together by drawing said rim 50 through the central opening in said tyre 20 from an outside face 23 of said tyre 20 until one or more locking means 22 arranged on said tyre 20 engages with said rim 50. In a second embodiment, the locking means 22 are arranged on said interior face 21 of the tyre 50.

The rim 50 is provided with one or more barbs 55*a*, i.e. inner barbs engaging with the axle 40, configured to engage radially with an external encircling groove. In one embodiment, the rim is provided with one or more barbs 55*a* in the range of 1 to 10 barbs, such as two, three, four, five or six barbs. In another embodiment, the rim is provided with one or more barbs 55*b*, i.e. engaging with the locking means 22 arranged on said interior face 21 of said tyre 50, in the range of 1 to 10 barbs, such as two, three, four, five or six barbs.

In a preferred embodiment of the present invention, the rim 50 of the toy wheel assembly is provided with at least two barbs 55*a* configured to engage radially with an external encircling groove 45 provided on said axle 40 when said axle 40 is inserted into an axle receiving hole 57 in said rim 50. In a further embodiment, said barbs 55*a* are arranged in opposed pairs.

In another preferred embodiment, the rim is provided with two barbs 55*b*, i.e. engaging with the locking means 22 are arranged on said interior face 21 of said tyre 50. In a further embodiment, said barbs 55*b* are arranged in opposed pairs.

The rim 50 is configured in such a way that once the axle is inserted in the receiving hole 57, the one or more barbs 55*a* will interact with the external encircling groove 45 on said axle 40 and prevent that the axle 40 is removed from the rim 50. In order to facilitate the mounting of the axle 40 on the rim 50, the barbs 55*a* may be configured to deflect in order to enable the insertion in the receiving hole 57 in said rim 50. Accordingly, in one embodiment, said barbs 55*a* are configured for deflecting when said axle 40 is inserted into said rim 50.

It is preferred that the axel 40 is configured with two opposing external encircling grooves 45, where one of the external encircling grooves is configured for mounting and maintaining the axel on the rim 50 of the wheel assembly and the opposing external encircling grooves 45 is configured for mounting and maintaining the other end of the axel 40 to the chassis of a toy vehicle. Accordingly, one embodiment concerns a toy wheel assembly 100 according to the present invention, wherein said axle 40 is provided with two opposed external encircling grooves 45, where one external encircling groove is configured for receiving a portion of said barbs 55*a* and where the opposed external encircling grove 45 is configured for receiving engagement means provided on a toy vehicle.

In one embodiment, the toy wheel assembly 100 of the invention is made or essentially made of plastic. In another embodiment, the tyre 20 is made of rubber. In another embodiment, the axel 40 is made of metal such as steel, iron or aluminium.

In the context of the present invention the term "rim" refers to a rim 50 with an integral hub adapted to receive the axel 40, mounted coaxially with said rim 50, by inserting the axle in the receiving hole 57. An example of such rim is a one piece integral hub wheel configured to receive a tyre 20 engages with the outer surface of said rim 50. Accordingly, the terms "rim", "hub" and "one piece integral hub wheel" may be used interchangeably. Likewise, the term "toy wheel assembly" may also refer to a toy steering wheel assembly.

It follows that the concept of the present invention may also be used to firmly mount a toy steering wheel on a toy vehicle. Accordingly, one particular embodiment concerns a toy steering wheel assembly, where the rim 50 refers to a hub of a toy wheel assembly 100 and where the axel 40 corresponds to a steering column and where the tyre 20 corresponds to the outer ring of the steering wheel. One or more spokes sprockets extending from the rim/hub 50 may either be an integral part of the rim 50 or the outer ring of the steering wheel.

A third aspect of the present invention concerns a chassis for a toy vehicle including a toy wheel assembly 100 or steering wheel assembly according to the present invention. The chassis with the toy wheel assembly 100 mounted on may be configured to receive a further part such as a building brick. Thus, the chassis with the toy wheel assembly 100 may be part of a toy kit.

It follows that once the wheel assembly 100, with the tyre 20 mounted on, is connected to the chassis of a toy vehicle it is even more difficult to dismantle the parts since the axel 40 to chassis connection prevents that the tyre 20 is moved towards the chassis to be dismantled from the rim 50.

A fourth aspect of the present invention concerns a toy vehicle including a toy wheel assembly 100 or steering wheel assembly according to the present invention. The toy vehicle may be a car, a truck, a train, a motorcycle or an airplane A further aspect of the present invention relates to a kit comprising a toy wheel assembly 100 of the present invention preferably mounted on a toy vehicle or the chassis for a toy vehicle.

In one embodiment, the toy wheel assembly 100 of the present invention is a component of a toy such as a LEGO® brick of a LEGO® toy or similar. In another embodiment, the kit of the present invention is a LEGO® toy kit.

The elements of the toy wheel assembly 100 of the present invention are typically manufactured by a method that comprises injection moulding in two or more steps. The method includes an injection moulding step wherein the element typically is injection moulded in one overall moulding step.

The element may be injection moulded in a mould cavity with an internal mould space having a shape that corresponds to the outer shape of the element. The mould typically constitutes a two part mould where one part of the mould defines the underside, or the interior, of the element and the other part of the mould defines the upper face and the exterior of the element.

The element is typically moulded by means of injecting hot material into the compiled moulds and subsequently, when various parameters such as temperature reach a predetermined range, separating the moulds.

Upon separation of the moulds, and subsequent removal of the element from one of the mould parts, the element typically constitutes a finished product.

In order to control large scale manufacture of injection moulded items such as manufacture of elements made of plastic, removal of the item or items from the mould may involve several steps of high sophistication. Typically, the items as well as one or more of the moulds, are designed to, upon separation of the moulds; maintain the item on or in the same mould part upon separation of the moulds.

The mould part on or in which the item is designed to stay or reside upon mould separation, typically is provided with means configured for removing or detaching the item from the mould. The means may constitute a mechanical ejector or equivalent.

Accordingly, a further aspect of the present invention concerns a moulding tool for use in the manufacture of a toy wheel assembly 100, wherein said mould comprises at least two mould parts, where one of said mould parts comprises a mould core which shapes said inner and opposed faces of at least one part of said a toy wheel assembly 100 selected from the list consisting of a rim 50, a tyre 20 and an axle 40.

Yet a further aspect concern a method for manufacturing a toy wheel assembly 100, wherein said method includes a step of injection moulding said toy wheel assembly 100 in a mould that comprises at least two mould parts, where one of said mould parts comprises a mould core which shapes said inner and opposed faces of at least one part of said a toy wheel assembly selected from the list consisting of a rim 50, a tyre 20 and an axle 40.

The application and combination of features and solutions presented by the present invention is not limited to the presented embodiments. One or more features of one embodiment can and may be combined with one or more features of other embodiments, whereby not described but valid, embodiments of the present invention may be obtained.

The term "comprises/comprising/comprised of" when used in this specification incl. claims is taken to specify the presence of stated features, integers, steps or components but does not preclude the presence or addition of one or more other features, integers, steps, components or groups thereof.

What is claimed is:

1. A toy wheel assembly for a toy vehicle, said toy wheel assembly including a rim, a tyre and an axle, wherein said tyre is configured to encircle an outer periphery of said rim when mounted on said rim, and wherein said axle is configured to be connected to said rim, coaxially with said rim, under a connection allowing said rim to rotate coaxially on said axle, wherein said rim includes one or more barbs configured to engage radially with an external groove provided on said axle when said axle is inserted into an axle receiving hole in said rim, wherein said one or more barbs are maintained in said external groove by an interior face of said tyre when said tyre is mounted on said rim, and wherein no section of the rim is subject to deflection away from the axle when said tyre is mounted on the rim.

2. A toy wheel assembly according to claim 1, wherein said tyre and said rim are configured to be drawn together by drawing said rim through a central opening in said tyre from an outside face of said tyre until one or more locking means arranged on said tyre engages with said rim.

3. A toy wheel assembly according to claim 2, wherein said locking means are arranged on said interior face of said tyre.

4. A toy wheel assembly according to claim 1, wherein said rim is provided with at least two barbs configured to engage radially with the external groove provided on said axle when said axle is inserted into the axle receiving hole in said rim.

5. A toy wheel assembly according to claim 4, wherein said barbs are arranged in opposed pairs.

6. A toy wheel assembly according to claim 1, wherein said barbs are configured for deflecting when said axle is inserted into said rim.

7. A toy wheel assembly according to claim 1, wherein said axle is provided with two opposed external grooves, where one external groove is configured for receiving a portion of said one or more barbs and where the opposed external grove is configured for receiving engagement means provided on a toy vehicle.

8. A toy wheel assembly according to claim 1, wherein said assembly is made of plastic.

9. A toy vehicle, wherein the toy vehicle includes a toy wheel assembly according to claim 1.

* * * * *